United States Patent [19]

Hedstrom

[11] 4,146,338

[45] Mar. 27, 1979

[54] END-OF-RIBBON SENSOR CIRCUITRY

[75] Inventor: Jerry W. Hedstrom, Plano, Tex.

[73] Assignee: Xerox Corporation, Stamford, Conn.

[21] Appl. No.: 782,793

[22] Filed: Mar. 30, 1977

[51] Int. Cl.[2] ..... B41J 35/36

[52] U.S. Cl. ..... 400/249; 400/208

[58] Field of Search ..... 197/151, 160, 161, 162, 197/163, 164, 165, 172, 173, 174, 187, 189

[56] References Cited

U.S. PATENT DOCUMENTS

| | | | |
|---|---|---|---|
| 3,730,449 | 5/1973 | Satas et al. | 197/165 X |
| 4,000,804 | 1/1977 | Zaltieri | 197/151 |

FOREIGN PATENT DOCUMENTS

| | | | |
|---|---|---|---|
| 1416295 | 12/1975 | United Kingdom | 197/151 |

*Primary Examiner*—Ernest T. Wright, Jr.

[57] ABSTRACT

End-of-ribbon sensor circuitry for use with an end-of-ribbon sensor of an electronic typing system comprises an input voltage divider for receiving the output signal of the end-of-ribbon sensor. The two signals from the voltage divider are applied to a differentiating circuit providing different time constants to the two signals. The differentiating circuit compensates for varying conditions of ambient light within the ribbon cartridge and provides a delay which eliminates false signals due to rapid fluctuations of the ribbon. After differentiation, the two signals are compared utilizing delayed switching time to determine the presence of an end-of-ribbon signal. The output, if any, of the comparator is applied to a sampling circuit where the signal is sampled for a predetermined period of time after the print hammer is fired. If an end-of-ribbon signal is present, said signal is clocked into a latching circuit from which it is sent to the printer control system which stops the printer when the present line of print is completed.

6 Claims, 10 Drawing Figures

END-OF-RIBBON SENSOR CIRCUITRY

CROSS REFERENCE TO RELATED APPLICATION

This application is related to and includes similar disclosure to copending U.S. Application Ser. No. 787,794 filed concurrently herewith in the name of Jerry W. Hedstrom for End-of-Ribbon Sensor Device and assigned to the assignee of the present invention.

BACKGROUND OF THE INVENTION

This invention relates, in general, to ribbon sensing apparatus and more particularly to circuitry used in conjunction with an end-of-ribbon sensor device for providing an indication of when the ink ribbon remaining on the supply spool has been depleted to a predetermined amount, such as the end portion.

In various commercially available typewriters and other data printing machines employing an ink ribbon in the printing process, it is normally desirable to provide means to indicate when the ink ribbon is essentially depleted from the supply spool. This requirement is more important when a matrix-type plastic ribbon is used rather than a cloth ribbon since the plastic ribbon is used only one time during the printing function. With the advent of the electronically controlled automatic text-editing typewriter employing a ribbon cartridge, it is even more important to provide such indicating means. Without some type of indication or control regarding the amount of ink ribbon remaining on the supply spool, a portion of a line or page could be automatically typed without the benefit of an ink ribbon.

It has been known to employ various types of physical pins or clips attached to the ribbon near the end of the ribbon supply to either physically move a lever or to provide electrical contact to sense the end portion of the ribbon remaining on the ribbon supply. It is also known to employ rod or lever means, which project through an opening in the ribbon supply hub upon the depletion of the ribbon on the ribbon supply spool, to sense the end portion of the ribbon. In addition, it is known to employ a lever or follower which contacts the outer periphery of the ink ribbon on the supply spool and through its pivotal motion during the depletion of the ink ribbon, signals the occurrence of the end portion of the ribbon on the ribbon supply spool. The previously discussed types of sensing mechanisms have been implemented in machines having an ink ribbon mechanism consisting of a ribbon supply spool and a ribbon take up spool mounted on opposite sides of the machine rather than being contained within a ribbon cartridge.

With machines employing the moving carriage with a ribbon cartridge mounted thereon, a smaller and less mechanically complex type of sensing mechanism is desired which may be mounted on the carriage for movement therewith. It would also be desirable to have the end-of-ribbon sensor be free of physical contact with the ribbon and thereby eliminate the problem of having the end-of-ribbon sensor become a factor in the determination of ribbon drive force or ribbon tension force required for the ribbon system. Presently, there is marketed a serial printer which employs a movable carriage with the ribbon cartridge and the daisy wheel print element mounted thereon. When an end-of-ribbon sensor is embodied in such an existing printer, which is presently embodied in a commercially available automatic text editing typewriter, it is desirable to provide such a sensor without requiring a significant redesign of the carriage and associated elements. When positioning an end-of-ribbon sensor on or attached to the moving carriage, which includes the ribbon cartridge, the sensor should not restrict the motion of the carriage or associated elements or cause appreciable dynamic problems due to its mass or friction. If the sensor is of the optical type, the sensor should function properly with different types of ribbons and different colors of ribbon and function properly under various light conditions normally found in the office environment. It is also desirable that the end-of-ribbon sensor provide an indication that the end of the ribbon is near but provide the indication at a point which allows the present line of typing to be completed prior to stopping the printer.

Circuitry associated with the end-of-ribbon sensor should provide a reliable and positive signal indicating the presence of the end portion of the ribbon.

Accordingly, it is a primary object of the present invention to provide improved circuitry to be used with an end-of-ribbon sensor with the circuitry providing a positive indication of the presence of the end of the ribbon.

Another object of this invention is to provide improved circuitry which incorporates components to introduce delay and comparison features to improve reliability of the indication of the end of the ribbon.

A further object of the present invention is to provide capability of sampling of the indication of the end-of-ribbon at specific times to improve reliability of the indication.

Other objects and advantages will be evident from the specification and claims when read in conjunction with the accompanying drawing illustrative of the invention.

SUMMARY OF THE INVENTION

In accordance with the principles illustrative of this invention, the foregoing objects and others of the present invention are accomplished by the provision of an end-of-ribbon sensor circuitry comprising an input voltage divider followed by a differentiating circuit. The step voltage from the end-of-ribbon sensor is applied to the voltage divider. The two signals provided from the voltage divider are applied to the differentiating circuit which provides different time constants to the two signals. After differentiation, one of the two signals is applied to the + terminal of an operational amplifier while the second signal is applied to the − terminal of the operational amplifier. The operational amplifier is turned on when the value of the voltage at the + terminal exceeds the value of the voltage at the − terminal. This operation provides a comparator function of the two applied voltages from the differentiating circuit with the different time constants providing a delayed switching time thereby increasing the reliability of the end-of-ribbon signal. The output of the operational amplifier is applied to a sampling circuit where the signal is sampled for a predetermined period of time after the print hammer is fired. If an end-of-ribbon signal is present during the sample time, this signal is applied to a latch circuit which sets the end-of-ribbon signal and sends the signal to the printer control system which stops the printer when the present line of print is completed.

BRIEF DESCRIPTION OF THE DRAWING

Other advantages and features of the present invention may become more apparent from reading the following detailed description in connection with the drawing forming a part thereof, in which.

DESCRIPTION OF THE PREFERRED EMBODIMENT

Figure 1:
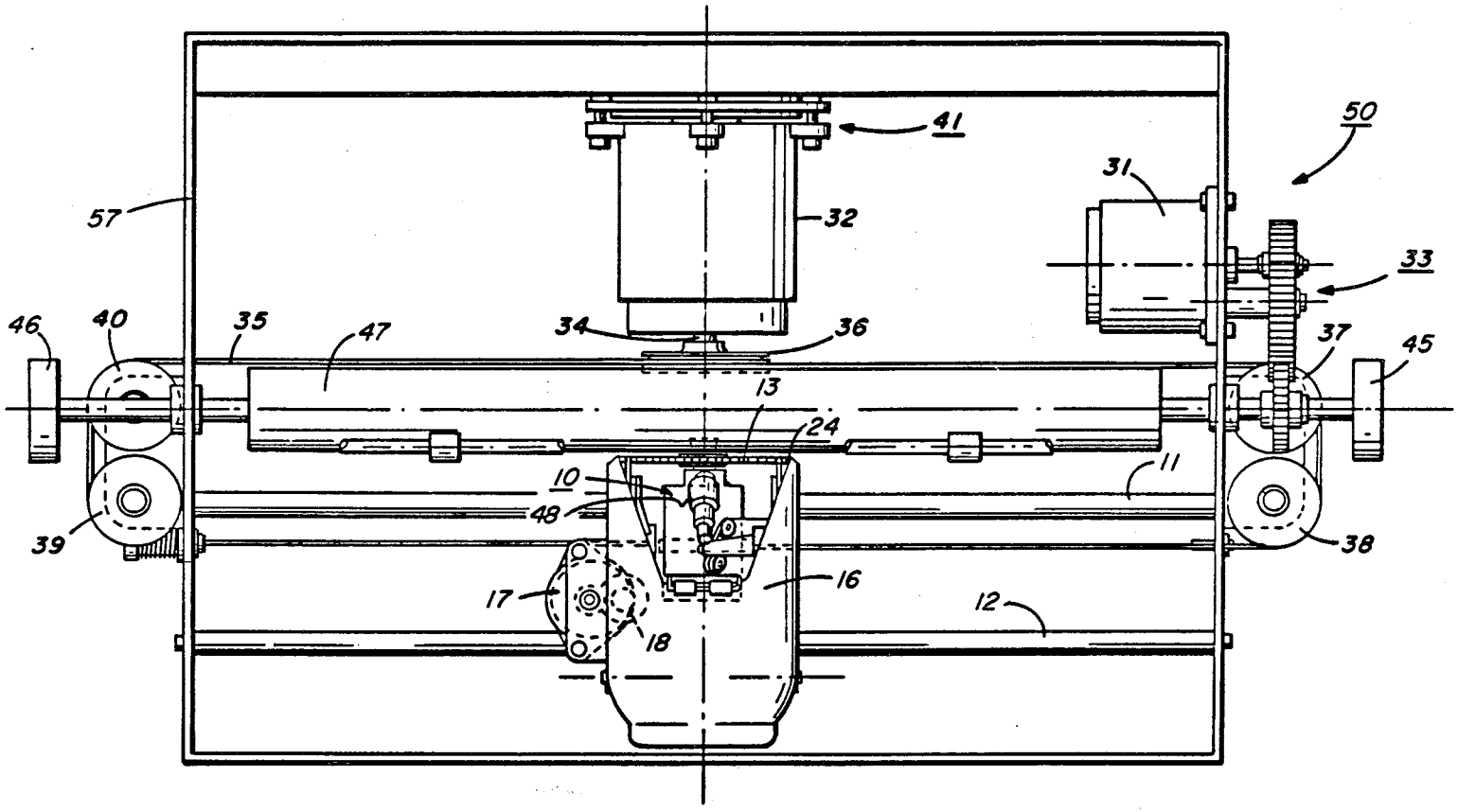
FIG. 1 is a top plan view of a printer embodying the present invention.

Referring now to the drawing and more particularly to FIG. 1, an overall view of the printer 50 embodying the present invention is illustrated. Mounted on a base frame 57 is a platen 47 with knobs 45 and 46 for rolling the platen 47 and paper record medium (not shown) wrapped thereon. A carriage 10 is mounted for linear movement on the carriage mounting rails 11 and 12 bridged between opposed side walls of the base frame 57 of the printer 50. Carriage 10 includes a rotary print wheel 13 on which are a number of type element or character slugs, a hammer-type impact printing mechanism 48 for striking a selected type element, a ribbon cartridge 16 having an inked ribbon 24 interposed between the paper on the platen 47 and the type element on the print wheel 13 located at the print position or station and a ribbon advance motor 17 as best shown in FIG. 2.

Furthermore, there are a stepping motor 31 and a servo motor 32 mounted on the base frame 57. The stepping motor 31 is coupled to the platen 47 by a gear train 33 so that the platen 47 is indexed when the motor 31 is activated to incrementally advance the paper through the printer 50. The servo motor 32, on the other hand, has one end of its drive shaft 34 coupled to the carriage 10 by a cable 35, which is trained around a series of pulleys 36–40, and the other end of its drive shaft 34 coupled to a shaft encoder 41. Thus, the carriage 10 is moved to translate the printing mechanism 48 lengthwise of the platen 47 when the servo motor 32 is actuated, while the encoder 41 supplies a signal which is representative of the actual position of the carriage 10 at any given time.

Figure 2:
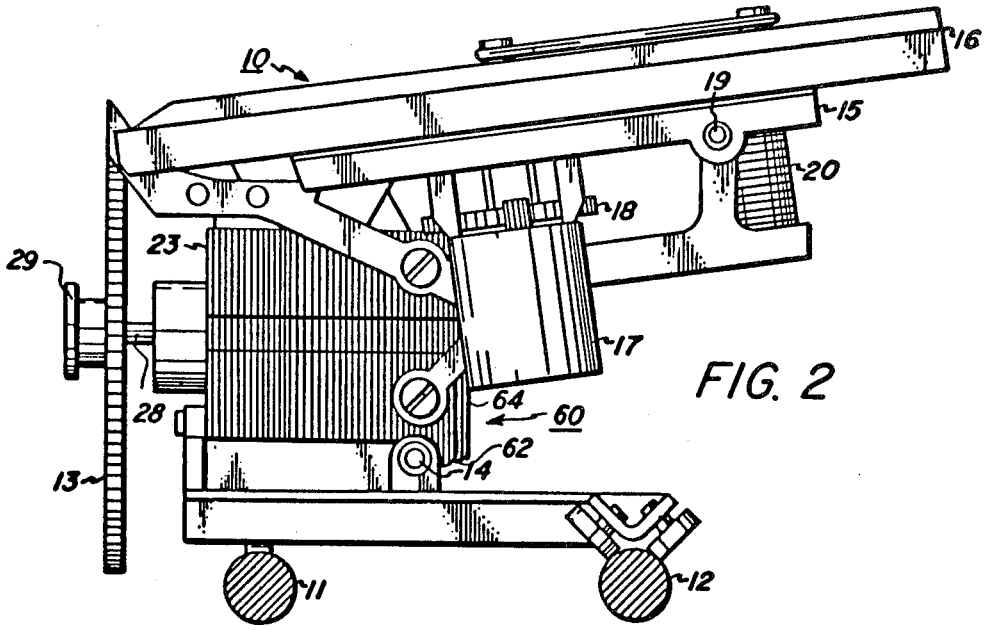
FIG. 2 is a side plan view of the carriage of the printer of FIG. 1.

With reference to FIGS. 1 and 2 and the printer carriage 10 mounted for linear movement on the mounting rails 11 and 12, as typing of the printed characters occurs, the carriage 10 stops each time a character is to be printed. Also, while the carriage 10 is moving from one location to the next location along rails 11 and 12 by movement of the cable 35, the print wheel 13 is rotated such that the next character to be printed will be in position at the print position or station when the carriage 10 stops and the printing mechanism 48 is fired. As seen in FIG. 2, the upper portion of carriage 10 is pivotable clockwise about shaft 14 with respect to the lower portion of carriage 10. This pivoting motion is necessary in order to bring the print wheel 13 up into a position such that the print wheel 13 may be exchanged for a different print wheel 13.

The ribbon cartridge mounting plate 15 provides the mounting structure for the ribbon cartridge 16, the ribbon advance motor 17 and the ribbon advance gearing 18. The ribbon cartridge mounting plate 15 is pivotable clockwise, in FIG. 2, about shaft 19. This pivoting motion is necessary to raise the ribbon 24 from the down position, which is the position that allows the printed material to be viewed by the operator, to the up position at the print station when printing is to occur. The force to pivot the ribbon cartridge mounting plate 15 is a magnetic force supplied by electromagnet coils 20. When coils 20 are energized, that portion of the ribbon cartridge mounting plate 15 above coils 20 is drawn down toward the coils 20 thereby raising that portion of the ribbon cartridge 16 which is nearest the print wheel 13 to the print position.

Still referring to FIGS. 1 and 2, carriage 10 also includes a motor 23 having a shaft 28. Mounted on one end of the shaft 28 is the rotary print wheel 13. Wheel 13 includes a central cap portion 29 constructed of rubber with a stiffening ring which allows the wheel 13 to be easily removed from the shaft 28 and, for example, replaced with another wheel 13 with, for example, a different font of characters. The other end of shaft 28 has mounted thereon a transducer 60 which provides position signals related to the rotary positions of the shaft 28 and, therefore, the print wheel 13. Transducer 60 includes a fixed disc 62 adjacent a disc 64 mounted for rotation with the shaft 28. Electrical interaction between these two discs 62 and 64 produced the position signals which are used in a servo system for controlling the print wheel 13. Consequently, when motor 23 is activated with the necessary signal, the print wheel 13 is rotated as necessary to bring any selected one of its character slugs into alignment with the hammer printing mechanism 48 for printing out the selected character. Additionally, the transducer 60 supplies a continuously updated signal which is representative of the actual position of the print wheel 13.

Figure 3:
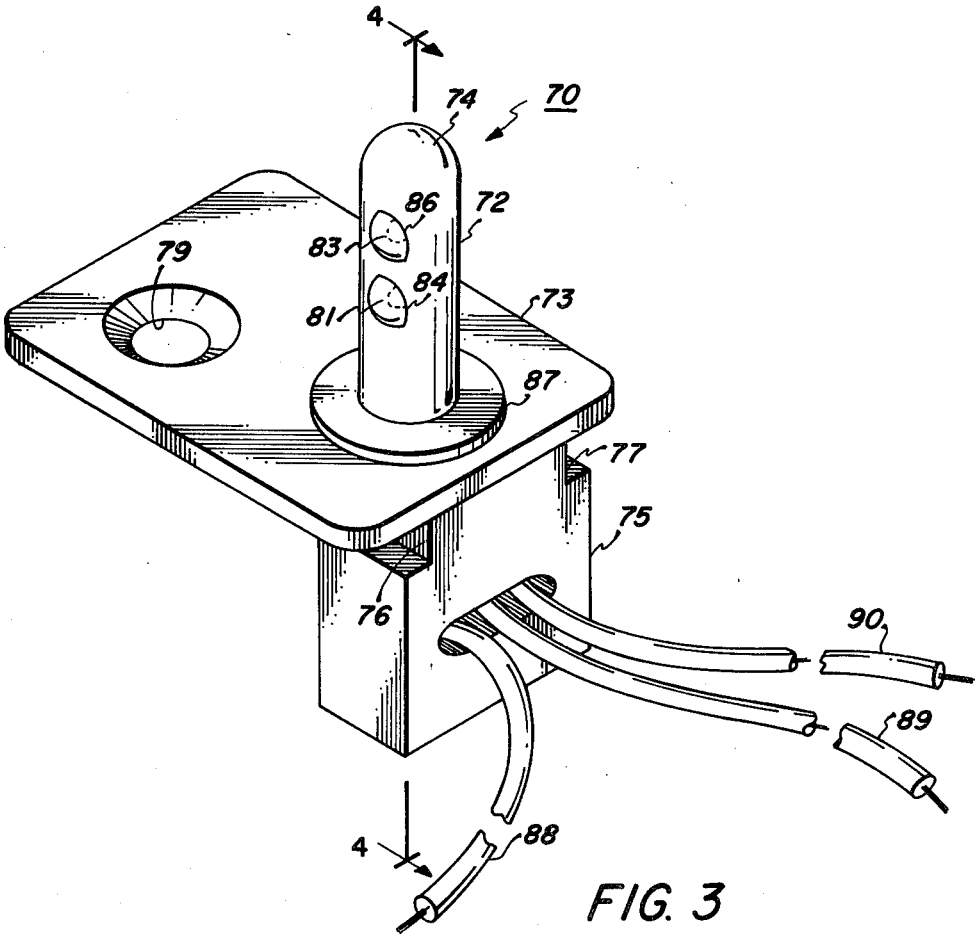
FIG. 3 is a simplified perspective view of the end-of-ribbon sensor device.
Figure 4:
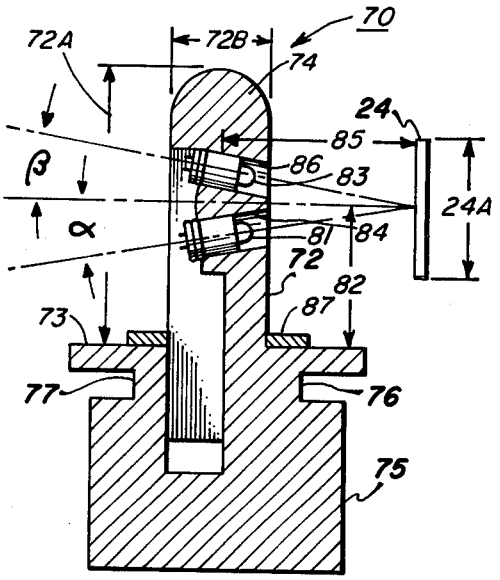
FIG. 4 is a simplified side sectional view of the end-of-ribbon sensor device taken generally along line 4—4 of FIG. 3 and also showing the positional relationship of the sensor device with respect to the ribbon.

Referring now to FIGS. 3 and 4, there is shown a simplified view of the end-of-ribbon sensor 70 for providing indication of the end portion of the ink ribbon 24 of the present invention. End-of-ribbon sensor 70 comprises a housing 72, which is cylindrical in the present embodiment, with a closed end portion 74. Housing 72 protrudes essentially at right angles from mounting plate 73, and the plane formed thereby, which is coupled to a substantially square mounting block 75. Cutouts 76 and 77 in block 75 cooperate with ribbon cartridge mounting plate 15 and an opening or cutout 22 formed therein to position sensor 70 on the ribbon cartridge mounting plate 15. Aperture 79, in mounting plate 73, cooperates in mounting the sensor 70 on the ribbon cartridge mounting plate 15. A light source 81 and a light detector 83 are positioned within housing 72 and cooperate through apertures 84 and 86 respectfully in the end-of-ribbon sensing function. The light source 81 may be any one of the semi-conductor type light emitters; however, a suitable example could be a type known as the solution-grown epitxial gallium assenide light emitting diode. Commercially available diodes which have been found to give the desired results are the light emitting diodes SE-1450 Series and SE-2450 Series, available from Spectronics Incorporated, which emit narrow-spectrum radiant energy in the near infrared region of the spectrum. Light detector 83 may be any one of the semi-conductor photo-voltaic cells or photo-transistors having a spectral response characteristic similar to that of the light source 81. A particular type of photo-transistor formed to give good results in this particular embodiment are photodarlingtons (silicon) SD-1410 Series and SD-2410 Series, available from Spectronics Incorporated. Washer 87 may be positioned down and over housing 72 to rest on and against plate 73. Washer 87 is preferably of a felt-type material which provides an additional light-sealing function between sensor 70 and ribbon cartridge 16 when the sensor 70 is in operative position with housing 72 being within the interior volume of ribbon cartridge 16. Electrical connections to the sensor 70 are made via electrical leads 88–90.

Referring now to FIG. 4, there is shown the positional relationship of the sensor 70 and the ribbon 24. The diameter of apertures 84 and 86 is preferably about 0.06 inches. The distance between horizontal centerlines of apertures 84 and 86 is preferably about 0.09 to 0.10 inches. The position of the apertures 84 and 86 along the length of housing 72 and the length or height 72A of housing 72 projecting above mounting plate 73 is dependent upon the height 24A of the ink ribbon 24 and the position of the ribbon 24 with respect to mounting plate 73. Preferably the length or height 72A of housing 72 and the position of apertures 84 and 86 will be such that the beam of light from light source 81 will strike approximately in the center of height 24A of ribbon 24 and be reflected back to light detector 83. In the particular embodiment described, height 72A is about 0.46 inches and the vertical distance or height 82, which is the distance from mounting plate 73 to the center point between apertures 84 and 86, is about 0.27 inches. The diameter 72B of housing 72 is preferably about 0.150 inches.

The beam of light from light source 81 is most intense in the center and considerably reduced in intensity off the center axis. Likewise, the sensitivity of the light detector 83 is greater to light received along the center of its axis of sight and considerably reduced in sensitivity to light received from off the center axis. In order to assure the maximum sensitivity of the overall operation of the sensor 70, the light source 81 and the light detector 83 are tilted or canted with respect to a plane passing through the center point between apertures 84 and 86, with said plane being parallel to the plane formed by mounting plate 73. The light source 81 is tilted or canted in an upward direction by an angle $\alpha$ from a plane passing through the centerpoint between apertures 84 and 86 and parallel to the plane formed by mounting plate 73 while the light detector 83 is tilted or canted in a downward direction by an angle B from said plane. Angles $\alpha$ and B may be varied over the range from 0° to 16° with the optimum preferred value being 8° for both $\alpha$ and B. With the distance 85 between the ribbon 24 and the vertical centerline of housing 72 being about 0.380 inches, the 8° of tilt to the center axis of both the light source 81 and the light detector 83 results in the center lines of both the light source 81 and light detector 83 intersecting at the ink ribbon 24. This intersecting results in the maximum amount of light being reflected along the center axis of light detector 83.

Figure 5:
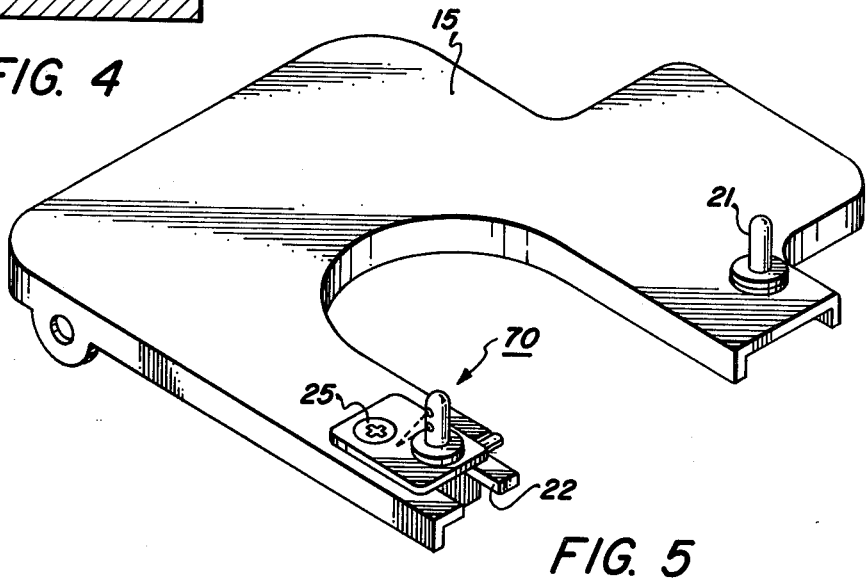
FIG. 5 is a simplified perspective view of the ribbon cartridge mounting plate embodying the end-of-ribbon sensor device.

With reference to FIG. 5, there is shown the ribbon cartridge mounting plate 15 with the end-of-ribbon sensor 70 mounted thereon. Prior to the present invention, the ribbon cartridge 16 was positioned on the ribbon cartridge mounting plate 15 by two guide pins positioned to interface with two compatible apertures in the lower cover section of the ribbon cartridge 16. Guide pin 21 in FIG. 5 is one of such prior positioning and alignment pins which remains on the ribbon cartridge mounting plate 15. The other guide pin was removed and replaced by the end-of-ribbon sensor 70 which was designed to have substantially the same diameter and height as the guide pin which it replaced; the end-of-ribbon sensor 70 is part of the mounting means for the ribbon cartridge 16. By designing the end-of-ribbon sensor 70 in this manner, the sensor 70 could be incorporated into the existing printer 50 without the need for a major redesign of the present printer 50 or the ribbon cartridges 16. Cutout 22 was formed in the ribbon cartridge mounting plate 15 and co-acts with cutouts 76 and 77 of mounting block 75 of the end-of-ribbon sensor 70 to assist in the mounting of sensor 70 to the ribbon cartridge mounting plate 15. Screw or bolt 25 in cooperation with aperture 79 and a corresponding aperture in the ribbon cartridge mounting plate 15 complete the mounting means for mounting sensor 70 on the mounting plate 15.

Figure 6:
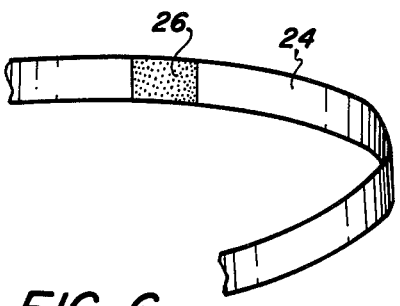
FIG. 6 is a simplified perspective view of the reflective tape positioned on the ribbon.

Referring now to FIG. 6, a portion of ink ribbon 24 is shown with a suitable marker 26 attached thereto for use in conjunction with end-of-ribbon sensor 70. The marker 26 has a reflective surface on that side of the marker 26 positioned away from the ribbon 24. The marker 26 is attached by suitable adhesive to the side of the ribbon 24 positioned away from the platen 47, FIG. 1, and at a predetermined distance from the physical end of the ribbon 24 such that when the marker 26 is detected, enough ribbon 24 will be available to complete the printing of any line which has been started. The marker 26 is substantially the same height as ribbon 24 and is approximately one-half inch in length. The material of the marker 26 in the disclosed embodiment is aluminized polyester. The scan side of ribbon 24 shall have a 300 NM to 1000 NM integrated reflection of less than 5% of the integrated 300 NM to 1000 NM of the aluminum polyester marker 26. With regard to reflective properties, ribbon 24 provides a low peaked response to light source 81 while marker 26 provides a high broad response.

Figure 7:
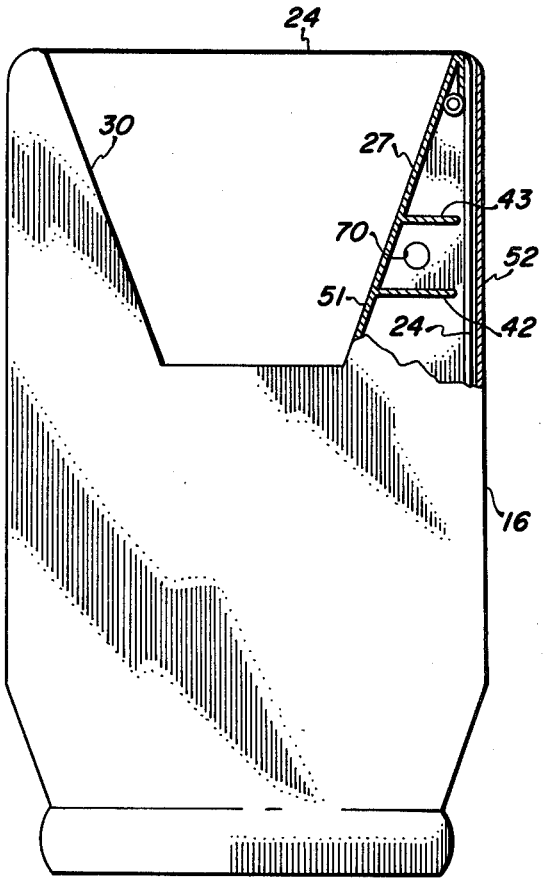
FIG. 7 is a simplified top view of the ribbon cartridge positioned on the mounting plate and with a portion of the top cover removed to disclose the end-of-ribbon sensor device positioned within the ribbon cartridge.

With reference to FIG. 7, the ribbon cartridge 16 is shown with a portion of the top cover removed to disclose the end-of-ribbon sensor 70 positioned within the interior volume of the ribbon cartridge 16. In addition, the positional relationship between the end-of-ribbon sensor 70 and the ribbon 24 is shown. Regarding ribbon path, the ribbon 24 passes from the ribbon supply means (not shown) past the end-of-ribbon sensor 70 and vanes 42 and 43 and out an aperture in horn 27, across the space between horns 27 and 30, into an aperture in horn 30 and then on to the ribbon take up means (not shown). Vanes 42 and 43 are positioned on either side of the end-of-ribbon sensor 70, with reference to the direction of travel of ribbon 24 past sensor 70, and are oriented at 90 degrees to the ribbon path. Vanes 42 and 43 extend from wall 51 to a predetermined distance from wall 52 to limit any flutter which occurs in ribbon 24 during the travel of ribbon 24. Vanes 42 and 43, in conjunction with wall 52 maintain the distance from the longitudinal centerline of end-of-ribbon sensor 70 to the ribbon 24 to approximately 0.38 inches, as shown in FIG. 4. The reduction of flutter of ribbon 24 reduces the range of signal levels from the end-of-ribbon sensor 70 when the ribbon 24 is being sampled for the presence of marker 26 and thereby reduces any false indications received. In addition, vanes 42 and 43 contribute to the reduction of any external light entering the ribbon cartridge 16 in the location of the end-of-ribbon sensor 70 and the ribbon 24. This reduction of background light tends to increase the accuracy and dependability of the overal function of end-of-ribbon sensing. The end-of-ribbon sensor 70 protrudes into the interior volume of ribbon cartridge 16 to provide the positional relationship with the ribbon 24 as shown in FIG. 4.

Figure 8:
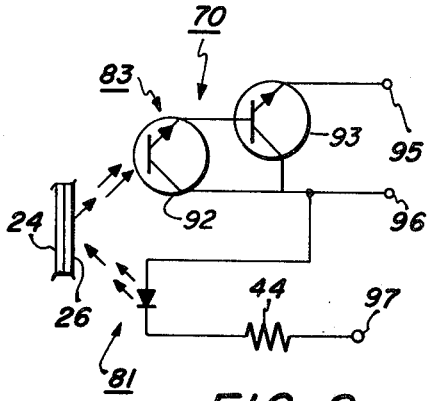
FIG. 8 is a simplified electrical schematic of the end-of-ribbon sensor device.

Referring now to FIG. 8, there is shown the simplified electrical schematic of the end-of-ribbon sensor 70. Light detector 83 comprises transistors 92 and 93. Transistor 92 has a light base electrode and an emitter electrode connected to the base electrode of transistor 93. Collector electrodes of transistors 92 and 93 are connected together and to terminal 96 to which a power supply voltage (not shown) such as a +5 volts, is supplied. The negative terminal of the power supply (not shown) is connected to terminal 97. Emitter electrode of transistor 93 is connected to terminal 95. The anode electrode of light source 81 is connected to terminal 96 while the cathode electrode is connected to terminal 97 through resistor 44, which biases light source 81. A load comprising the end-of-ribbon sensor circuitry 100, which will be discussed later, is connected between terminals 95 and 97. In operation, energy radiated from light source 81 is reflected from the ribbon 24 or the marker 26, if the ribbon 24 in the ribbon cartridge 16 has been used to that position, and activates transistor 92 which in turn activates transistor 93. If the ribbon 24 reflects the energy, the end-of-ribbon sensor 70 provides approximately 0.2 milliamperes to the sensor circuitry 100 while sensor 70 supplies approximately 1.3 milliamperes to sensor circuitry 100 if the marker 26 is in position to reflect the energy to light detector 83.

Figure 9:
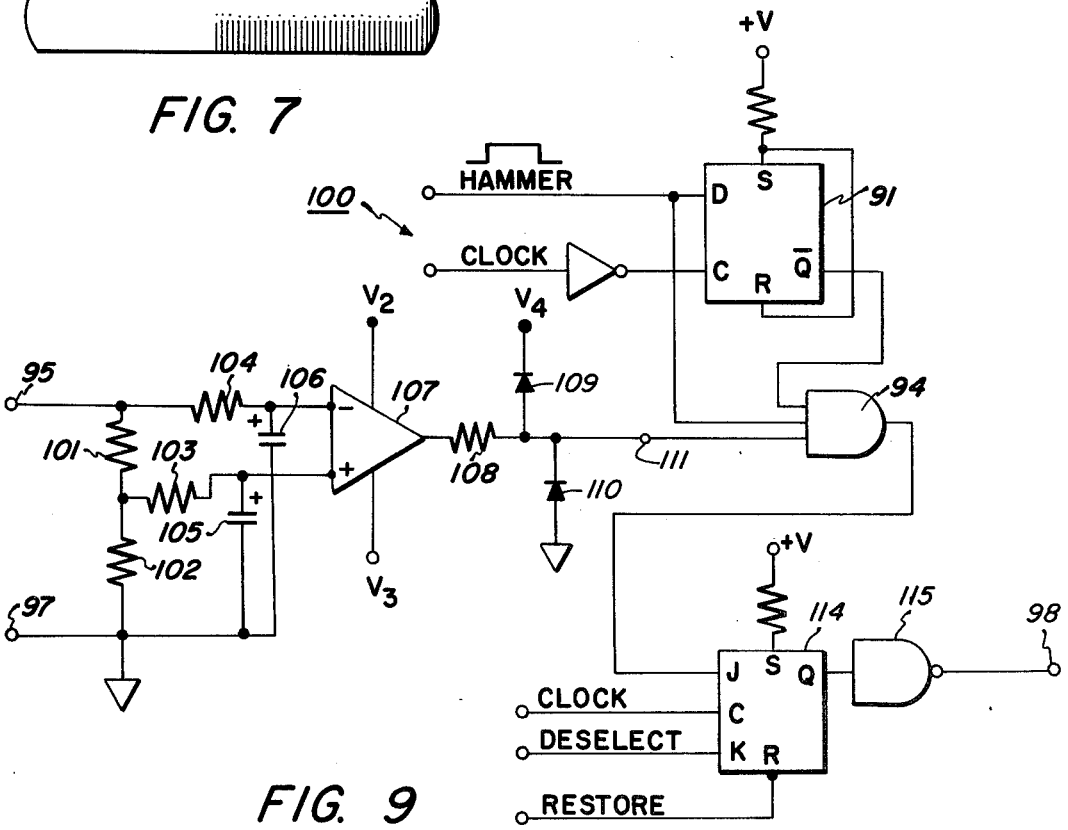
FIG. 9 is a simplified schematic of the circuit used in conjunction with the end-of-ribbon sensor device.

With reference to FIG. 9, there is shown the simplified schematic of the end-of-ribbon sensor circuitry 100 used in conjunction with the end-of-ribbon sensor 70. Resistors 101 and 102 are connected in series across terminals 95 and 97. Resistor 104 is connected from terminal 95 to the negative input terminal of operational amplifier (op amp) 107. Resistor 103 is connected from the junction point between resistors 101 and 102 to the positive input terminal of op amp 107. Capacitor 105 is connected from terminal 97 to the positive input terminal of op amp 107 while capacitor 106 is connected from terminal 97 to the negative input terminal of op amp 107. The output of op amp 107 is connected to terminal 111 through resistor 108. Diode 109 is connected from terminal 111 to $V_4$ to which is applied, for example, +5 volts. Diode 110 is connected from terminal 111 to ground and/or terminal 97 which is grounded. Plus 15 volts are applied to the $V_2$ terminal of op amp 107 while minus 15 volts are applied to the $V_3$ terminal of op amp 107. Resistors 101 and 102 form a voltage divider for the output of the end-of-ribbon sensor 70. In the disclosed embodiment, resistor 101 has a value of 1.5 K ohms and resistor 102 has a value of 1 K ohms. This combination results in the voltage at the junction between resistors 101 and 102 being two-fifths the value of the voltage at terminal 95 across both the resistors 101 and 102. These two voltages are filtered by respective filters, with the voltage at terminal 95 being filtered by resistor 104 and capacitor 106 prior to application to the op amp 107. In the disclosed embodiment, resistor 104 is 390 K ohms and capacitor 106 is 22 mfd. giving a time constant of approximately 8 seconds. The voltage at the junction between resistors 101 and 102 is filtered by resistor 102 and capacitor 105 prior to application to op amp 107. In the disclosed embodiment, resistor 103 is 5.1K ohms and capacitor 105 is 10 mfd. giving a time constant of approximately 50 milliseconds. The time constant of resistor 104 and capacitor 106 is so long with respect to variations in the voltage at terminal 95 that the voltage applied to the negative input terminal of op amp 107 is effectively the average of the previous 8 seconds. The voltage applied to the positive input terminal of op amp 107 is two-fifths of the instantaneous value of the signal at terminal 95 with a 50 millisecond time constant low pass filter to remove unwanted noise. The applicable equations are:

$$V_{(neg)} = V_{95}(1 - e(t/1_1) \quad (1)$$

$$V_{(pos)} = 2/5\ V_{95}(1 - e(t/1_2) \quad (2)$$

Where $T_1$ = (capacitor 106)(Resistor 104) $T_2$ = (capacitor 105)(Resistor 103)

$V_{(neg)}$ is the voltage at the − terminal of op amp 107

$V_{(pos)}$ is the voltage at the + terminal of op amp 107

$V_{95}$ is the voltage at terminal 95

The voltage applied to the + terminal of op amp 107 is the reference voltage. In this embodiment, op amp 107 is used as a comparator; op amp 107 is either completely on or completely off. Op amp 107 is comparing two-fifths of the average voltage with the total voltage at terminal 95. The output of op amp 107 is high whenever the voltage at the + terminal is greater than the voltage at the − terminal.

When power is fist applied, the voltages at the − and + terminal of op amp 107 stabilize in 8 seconds and 50 milliseconds, respectively. The reason for the two time constants is to provide a delayed switching time so the op amp 107 will delay switching. The delayed switching is provided so the system will not respond to ribbon flutter or variation in ribbon reflection due to different types of ribbon 24 to be used with the typing system.

The differentiating circuit comprising resistor 102 together with capacitor 105 and resistor 104 together with capacitor 106 compensates for varying background light and different ribbon materials and ribbon colors to which the end-of-ribbon sensor 70 is exposed. The differentiating circuit biases itself in accordance with the background light and different ribbon materials and ribbon colors. The 8 second average signal applied to the — terminal of op amp 107 will change with the background light and different ribbon materials and color to which the end-of-ribbon sensor 70 is exposed and includes the average of reflected signals from the ribbon 24 as well as the ambient light introduced into the end-of-ribbon sensor 70. Ribbon cartridges do leak some light in by way of the seams of the cartridges but since this circuit compensates for varying conditions of ambient light within the cartridge 16, the system works in the range of conditions from having the typing system in direct sunlight to having the system in total darkness. The switching delay eliminates false end-of-ribbon indications due to rapid fluctuations of the ribbon 24 and/or signal from the end-of-ribbon sensor 70.

Figure 10:
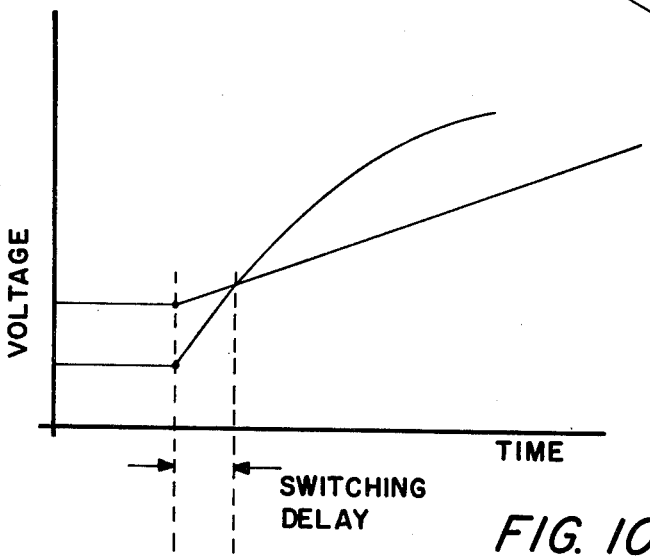
FIG. 10 shows two waveforms of voltages appearing in the schematic of FIG. 9.

Referring to FIG. 10, there is shown the two waveforms associated with the two time constants discussed above. When the marker 26 is sensed by the end-of-ribbon sensor 70, the output current changes from approximately 0.2 milliamperes to approximately 1.3 milliamperes and the voltages applied to op amp 107 change as depicted in FIG. 10. Op amp 107 switches when the voltage at the + terminal exceeds the voltage at the − terminal, with the switching delay being the time taken for the voltage on the + terminal to rise above the voltage on the − terminal. For this particular embodiment, the delay is approximately 13.6 milliseconds. This time delay is sufficient to filter out any fluctuations associated with the signal reflected from the ribbon 24.

Referring again to FIG. 9, diodes 109 and 110 limit the excursion of the output of op amp 107 and makes the output compatible with and allows interface with transistor-transistor-logic (TTL). For the disclosed embodiment, the output of op amp 107 is 5.8 volts when the voltage at the + terminal is greater than the − terminal and −0.7 volts when the − terminal is greater.

A sample circuit comprising a D flip-flop 91 and an AND gate 94 provide a sampled end-of-ribbon signal every two microseconds out of every 30 milliseconds during the printing operation. The sample circuit brings the print hammer signal and the clock signal together through D flip-flop 91. The clock pulse provides a 2 microsecond pulse everytime the print hammer mechanism is fired. The application of the clock pulse and hammer pulse to D flip-flop 91 provide an output on Q which is anded with hammer pulse and the end-of-ribbon pulse in AND gate 94. The output of AND gate 94 is high only when the hammer, Q and end-of-ribbon signals are high and is a 2 microsecond sampled end-of-ribbon signal. This provides additional filtering and reduces the possibility of an erroneous end-of-ribbon shutdown of the typing system.

The sampled end-of-ribbon signal is provided as the input to a latch circuit comprising J-K flip flop 114. The clock pulse applied to C terminal of flip flop 114 sets a level at Q terminal which is clocked in sequence with the sampled end-of-ribbon signal applied to the J terminal which sets the output signal at Q to a high value. NAND gate 115 inverts the high signal and sends the resulting low level signal to the control system via output terminal 98 for the printing system. The control system recognizes the signal and shuts down the printer 50 at the completion of the line of printing.

In summary, the radiation or light reflected from marker 26 caused a step increase in signal from the end-of-ribbon sensor 70. This signal was filtered and delayed by a predetermined time to assure it is a valid signal. The signal is then fed through a digital filter 91 and 94 to further assure the validity and reliability thereof. The resulting signal is then fed to a clocked latch circuit 114 and on to the control system which shuts down the printer 50 at the end of the line of printing.

The operator activates the shutdown printer 50 by opening the cover which by an appropriate switch activates the application of a deselect signal to the K terminal of J-K flip-flop 114 which sets Q to a low level thereby resetting the circuits. Upon closing the cover, after replacing the ribbon cartridge 16 with a new one, the system is readied for further printing. The signals and operation of the control system is described in copending and commonly assigned United States patent applications of H. Wallace Swanstrom et al. which were filed Jan. 2, 1974, under Ser. No. 429,479 and Oct. 15, 1975, under Ser. No. 622,780, both of which are hereby incorporated by reference.

Although the present invention has been described with reference to a presently preferred embodiment, it will be appreciated by those skilled in the art that various modifications, alternatives, variations, etc., may be made without departing from the spirit and scope of the invention as defined in the appended claims.

What is claimed is:

1. In a serial printer having an end-of-ribbon sensor, an improved end-of-ribbon sensor circuit comprising:

a voltage divider receiving an output signal from the end-of-ribbon sensor;

a differentiating means receiving two output signals from said voltage divider, said differentiating means including means for varying the two received signals according to different time constants; and a comparator means receiving two differentiated output signals from said differentiating means, one of said differentiated output signals providing a reference source for said comparator means, said comparator means generating an output signal if the other differentiated output signal which is compared against the reference source is lower in magnitude than said reference source, the presence of said output signal from said comparator means providing an indication of the end portion of a ribbon.

2. Circuitry as set forth in claim 1 wherein said different time constants are approximately 8 seconds and approximately 50 milliseconds.

3. Circuitry as set forth in claim 1 where said comparator means compares a predetermined fraction of the average voltage over a predetermined time period from the end-of-ribbon sensor with the real time voltage from the end-of-ribbon sensor.

4. Circuitry as set forth in claim 1 further including an output limiting means for receiving the output signal from said comparator means.

5. Circuitry as set forth in claim 4 further including a sampling circuit for receiving the output signal from said output limiting means wherein said sampling circuit is sampled for a predetermined period of time after a print hammer mechanism in the printer has been activated.

6. Circuitry as set forth in claim 5 further including a latch circuit for receiving the output signal of said sampling circuit, wherein said sampling circuit provides an output signal to be acted upon by said printer.

* * * * *

UNITED STATES PATENT AND TRADEMARK OFFICE

CERTIFICATE OF CORRECTION

PATENT NO. : 4,146,338

DATED : March 27, 1979

INVENTOR(S) : Jerry W. Hedstrom

It is certified that error appears in the above-identified patent and that said Letters Patent are hereby corrected as shown below:

Column 1, line 8, change "787,794" to --782,794--.

Column 8, line 12, change "102" (second occurrence) to --103--.

Column 8, line 44, change "fist" to --first--.

Column 8, line 52, change "102" to --103--.

Column 9, line 24, change "5.8" to --5.7--.

Signed and Sealed this

*Fourteenth* Day of *August 1979*

[SEAL]

*Attest:*

*Attesting Officer*

LUTRELLE F. PARKER

*Acting Commissioner of Patents and Trademarks*